US009109859B1

(12) United States Patent
Nittolo et al.

(10) Patent No.: US 9,109,859 B1
(45) Date of Patent: Aug. 18, 2015

(54) SPINE PLATE VEST

(71) Applicants: John A Nittolo, Margate, FL (US); Charles W. De Angelo, Boca Raton, FL (US)

(72) Inventors: John A Nittolo, Margate, FL (US); Charles W. De Angelo, Boca Raton, FL (US)

( * ) Notice: Subject to any disclaimer, the term of this patent is extended or adjusted under 35 U.S.C. 154(b) by 0 days.

(21) Appl. No.: 14/542,523

(22) Filed: Nov. 14, 2014

(51) Int. Cl.

| | |
|---|---|
| ***A41H 1/02*** | (2006.01) |
| ***F41H 1/02*** | (2006.01) |
| ***A41D 13/05*** | (2006.01) |
| ***A41D 13/00*** | (2006.01) |

(52) U.S. Cl.
CPC ..... *F41H 1/02* (2013.01); *A41D 13/0012* (2013.01); *A41D 13/0531* (2013.01)

(58) Field of Classification Search
CPC .. F41H 1/00; A41D 13/0518; A41D 13/0531; A41D 13/0575; A41D 31/005; A41D 31/0005; A41D 1/04; A41D 13/0012; A41F 1/02
USPC ..... 2/102, 2.5, 466, 463, 467; 428/911; 442/134, 135
See application file for complete search history.

(56) References Cited

U.S. PATENT DOCUMENTS

| | | | | |
|---|---|---|---|---|
| 8,528,112 | B2 * | 9/2013 | Blauer et al. | 2/2.5 |
| 2008/0010730 | A1 * | 1/2008 | Twito et al. | 2/463 |
| 2009/0282595 | A1 * | 11/2009 | Branson et al. | 2/2.5 |
| 2010/0076359 | A1 * | 3/2010 | Glenn | 602/19 |
| 2010/0088799 | A1 * | 4/2010 | Carter | 2/102 |
| 2010/0152636 | A1 * | 6/2010 | Parks et al. | 602/19 |
| 2010/0294820 | A1 * | 11/2010 | Neibarger | 224/576 |
| 2011/0114684 | A1 * | 5/2011 | Ya'akobovich et al. | 224/259 |
| 2011/0231976 | A1 * | 9/2011 | Herbener et al. | 2/2.5 |
| 2012/0024924 | A1 * | 2/2012 | Hexels | 224/576 |
| 2012/0132066 | A1 * | 5/2012 | Seuk | 89/36.05 |
| 2012/0180178 | A1 * | 7/2012 | Gallo | 2/2.5 |
| 2013/0042376 | A1 * | 2/2013 | Hexels | 2/2.5 |
| 2013/0047320 | A1 * | 2/2013 | Gleason | 2/312 |
| 2013/0061362 | A1 * | 3/2013 | Crye et al. | 2/2.5 |
| 2013/0256358 | A1 * | 10/2013 | Beck | 224/641 |
| 2013/0312149 | A1 * | 11/2013 | Asher et al. | 2/2.5 |
| 2013/0312150 | A1 * | 11/2013 | Klein | 2/2.5 |
| 2014/0101810 | A1 * | 4/2014 | Tirard | 2/2.5 |
| 2014/0201879 | A1 * | 7/2014 | Seuk et al. | 2/2.5 |
| 2014/0208475 | A1 * | 7/2014 | Khandelwal | 2/2.5 |

FOREIGN PATENT DOCUMENTS

| | | | | |
|---|---|---|---|---|
| WO | WO 2010059951 | A1 * | 5/2010 | F41H 1/02 |
| WO | WO 2011002784 | A1 * | 1/2011 | A45F 3/04 |

* cited by examiner

*Primary Examiner* — Alissa L Hoey
(74) *Attorney, Agent, or Firm* — Carey Rodriguez; Adam C. Underwood; Emesto Rubi

(57) ABSTRACT

A spine plate vest includes a back support including an inward-facing side opposite an outward-facing side and connected to a center portion of a waistband, a first pocket positioned on the inward-facing side of the back support and adapted for receiving a gel pack, a second pocket positioned on the outward-facing side of the back support and adapted for receiving a spine ballistic plate, a first metal bar adapted to receive a first side end of the ballistic plate, a second metal bar adapted to receive a second side end of the ballistic plate, the waistband connected to the inward-facing side of the back support, a first plurality of pockets adapted for receiving a plurality of gel packs on an inward-facing side of the waistband, a plurality of ballistic plates positioned between the inward-facing side and the outward-facing side of the waistband and a shoulder interface.

4 Claims, 10 Drawing Sheets

SPINE PLATE VEST

BACKGROUND OF THE INVENTION

1. Field of the Invention

The present invention relates to back support vests and more particularly to a back support vest that provides improve weight distribution of heavy tactical bulletproof vests and backpacks.

2. Description of the Related Art

Conventional tactical bulletproof vests are heavily weighted and significantly restrict the mobility of the user. In addition, the heavy weight of a conventional tactical bulletproof vest is unevenly distributed, which can cause numerous injuries that are associated with wearing a conventional tactical bulletproof vest including back and leg injuries. Furthermore, conventional tactical bulletproof vests fail to fully deflect and dissipate the impact of a bullet, shrapnel and/or other ballistic projection from the delicate spinal region.

BRIEF SUMMARY OF THE INVENTION

Embodiments of the present invention address deficiencies of the art in respect to heavy tactical bulletproof vests and backpacks and provide a novel and non-obvious spine plate vest and spine plate vest system adapted to redistribute the weight of heavy tactical bulletproof vests and backpacks. In addition, the spine plate vest provides spine protection from bullet and/or fragment impact in the spine region by diverting and dissipating the kinetic and concussive energy away from the spine to less injury prone portions of the back of the user. In an embodiment of the invention, a spine plate vest includes a back support including an inward-facing side opposite an outward-facing side, the inward-facing side connected to a center portion of a waistband, a first pocket positioned on the inward-facing side of the back support and adapted for receiving a gel pack, a second pocket positioned on the outward-facing side of the back support and adapted for receiving a spine ballistic plate, a first metal bar positioned between the inward-facing side and the outward-facing side of the back support, the first metal bar adapted to receive a first side end of the ballistic plate, a second metal bar positioned between the inward-facing side and the outward-facing side of the back support, the second metal bar adapted to receive a second side end of the ballistic plate, the waistband including an inward-facing side opposite an outward-facing side, the outward-facing side connected to the inward-facing side of the back support, a first plurality of pockets adapted for receiving a plurality of gel packs on the inward-facing side, a plurality of ballistic plates positioned between the inward-facing side and the outward-facing side of the waistband and a shoulder interface including a first flexible metal bar positioned between an inward-facing side and an outward-facing side of the shoulder interface a second flexible metal bar positioned between the inward-facing side and the outward-facing side of the shoulder interface, where the shoulder interface defines a first connection prong and a second connection prong protruding from a base portion of the shoulder interface, the base portion coupled to an upper end of the back support.

In an embodiment of the invention, a spine plate vest system includes a spine plate vest coupled to a tactical bulletproof vest, where the spine plate vest includes a back support including an inward-facing side opposite an outward-facing side, the inward-facing side connected to a waistband, a first pocket positioned on the inward-facing side of the back support and adapted for receiving a gel pack, a second pocket positioned on the outward-facing side of the back support and adapted for receiving a spine ballistic plate, a first metal bar positioned between the inward-facing side and the outward-facing side of the back support, the first metal bar adapted to receive a first side end of the ballistic plate, a second metal bar positioned between the inward-facing side and the outward-facing side of the back support, the second metal bar adapted to receive a second side end of the ballistic plate, the waistband including an inward-facing side opposite an outward-facing side, the outward-facing side connected to the inward-facing side of the back support, a first plurality of pockets adapted for receiving a plurality of gel packs on the inward-facing side, a plurality of ballistic plates positioned between the inward-facing side and the outward-facing side of the waistband and a shoulder interface including a first flexible metal bar positioned between an inward-facing side and an outward-facing side of the shoulder interface a second flexible metal bar positioned between the inward-facing side and the outward-facing side of the should interface, where the shoulder interface defines a first connection prong and a second connection prong protruding from a base portion of the shoulder interface, the base portion coupled to an upper end of the back support.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
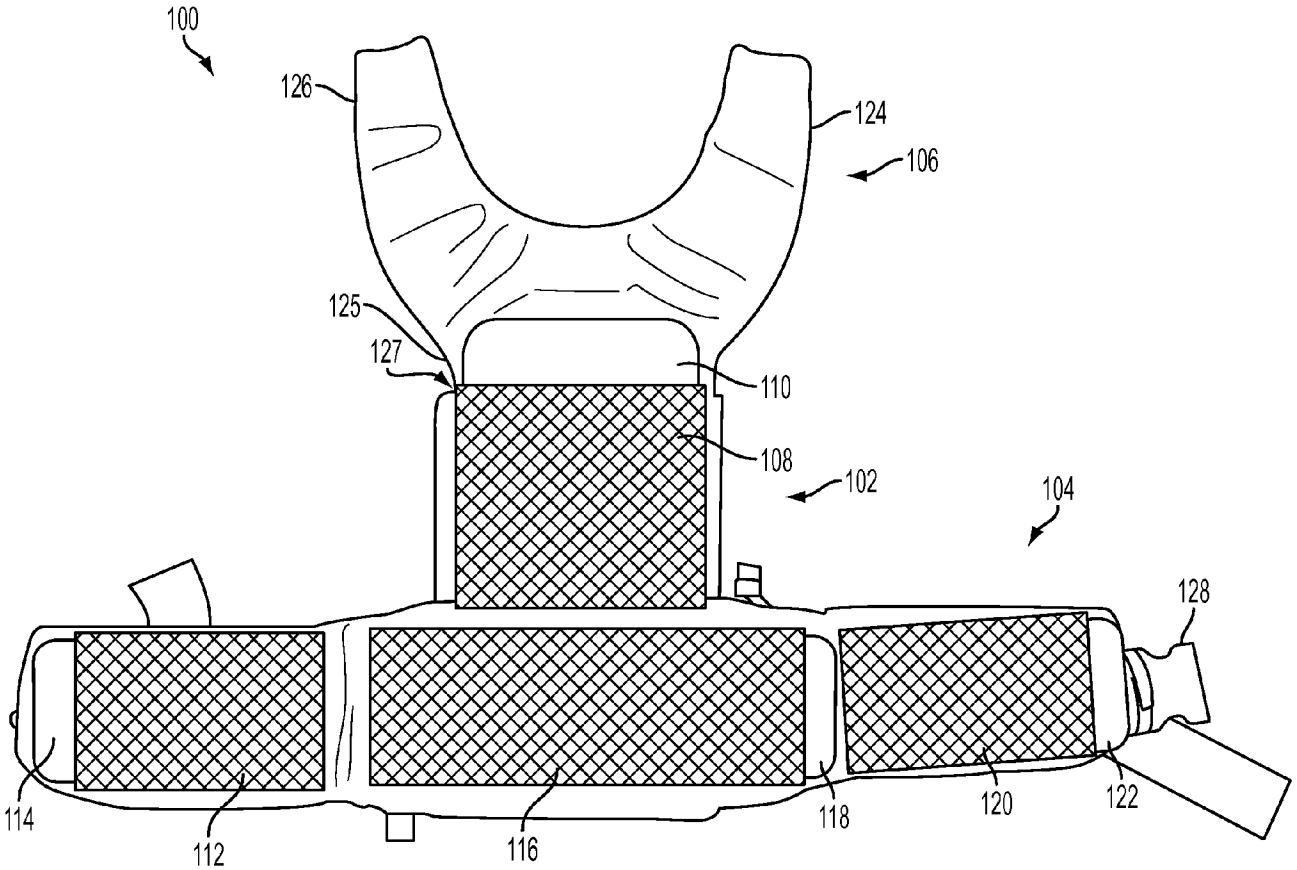
FIG. 1 is a front view of an interior of a spine plate vest according to an exemplary embodiment.

Embodiments of the present invention address deficiencies of the art in respect to heavy tactical bulletproof vests and backpacks and provide a novel and non-obvious spine plate vest and spine plate vest system adapted to redistribute the weight of heavy tactical bulletproof vests and backpacks. In addition, the spine plate vest provides spine protection from bullet and/or fragment impact in the spine region by diverting and dissipating the kinetic and concussive energy away from the spine to less injury prone portions of the back of the user. In an embodiment of the invention, a spine plate vest includes a back support including an inward-facing side opposite an outward-facing side, the inward-facing side connected to a center portion of a waistband, a first pocket positioned on the inward-facing side of the back support and adapted for receiving a gel pack, a second pocket positioned on the outward-facing side of the back support and adapted for receiving a spine ballistic plate, a first metal bar positioned between the inward-facing side and the outward-facing side of the back support, the first metal bar adapted to receive a first side end of the ballistic plate, a second metal bar positioned between the inward-facing side and the outward-facing side of the back support, the second metal bar adapted to receive a second side end of the ballistic plate, the waistband including an inward-facing side opposite an outward-facing side, the outward-facing side connected to the inward-facing side of the back support, a first plurality of pockets adapted for receiving a plurality of gel packs on the inward-facing side, a plurality of ballistic plates positioned between the inward-facing side and the outward-facing side of the waistband and a shoulder interface including a first flexible metal bar positioned between an inward-facing side and an outward-facing side of the shoulder interface a second flexible metal bar positioned between the inward-facing side and the outward-facing side of the shoulder interface, where the shoulder interface defines a first connection prong and a second connection prong protruding from a base portion of the shoulder interface, the base portion coupled to an upper end of the back support.

In another embodiment of the invention, a spine plate vest system is provided. The spine plate vest system can include a spine plate vest coupled to a tactical bulletproof vest, where the spine plate vest includes a back support including an inward-facing side opposite an outward-facing side, the inward-facing side connected to a center portion of a waistband, a first pocket positioned on the inward-facing side of the back support and adapted for receiving a gel pack, a second pocket positioned on the outward-facing side of the back support and adapted for receiving a spine ballistic plate, a first metal bar positioned between the inward-facing side and the outward-facing side of the back support, the first metal bar adapted to receive a first side end of the ballistic plate, a second metal bar positioned between the inward-facing side and the outward-facing side of the back support, the second metal bar adapted to receive a second side end of the ballistic plate, the waistband including an inward-facing side opposite an outward-facing side, the outward-facing side connected to the inward-facing side of the back support, a first plurality of pockets adapted for receiving a plurality of gel packs on the inward-facing side, a plurality of ballistic plates positioned between the inward-facing side and the outward-facing side of the waistband and a shoulder interface including a first flexible metal bar positioned between an inward-facing side and an outward-facing side of the shoulder interface a second flexible metal bar positioned between the inward-facing side and the outward-facing side of the shoulder interface, where the shoulder interface defines a first connection prong and a second connection prong protruding from a base portion of the shoulder interface, the base portion coupled to an upper end of the back support.

Figure 2:
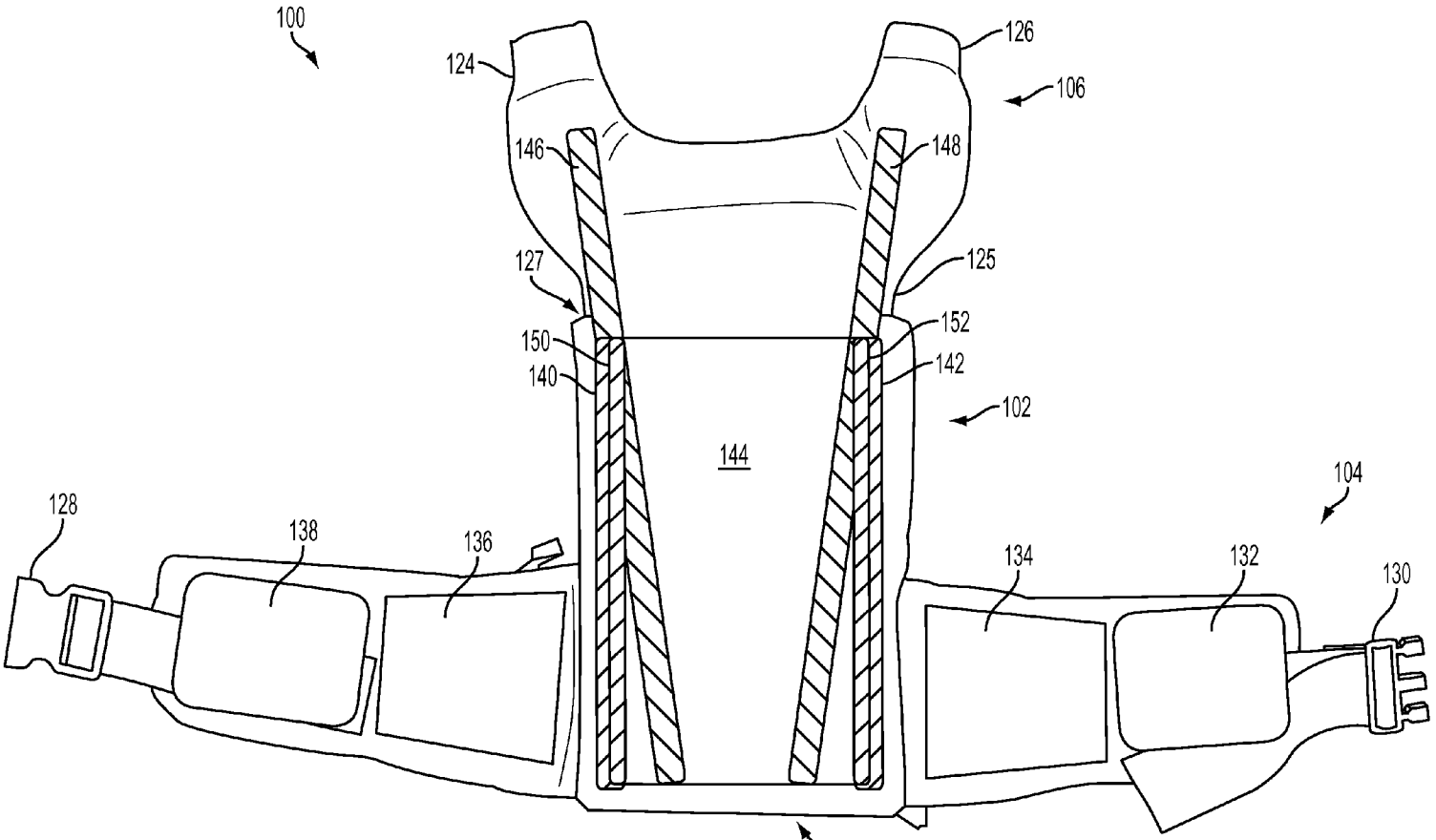
FIG. 2 is a back view of an exterior of a spine plate vest according to an exemplary embodiment.
Figure 3:
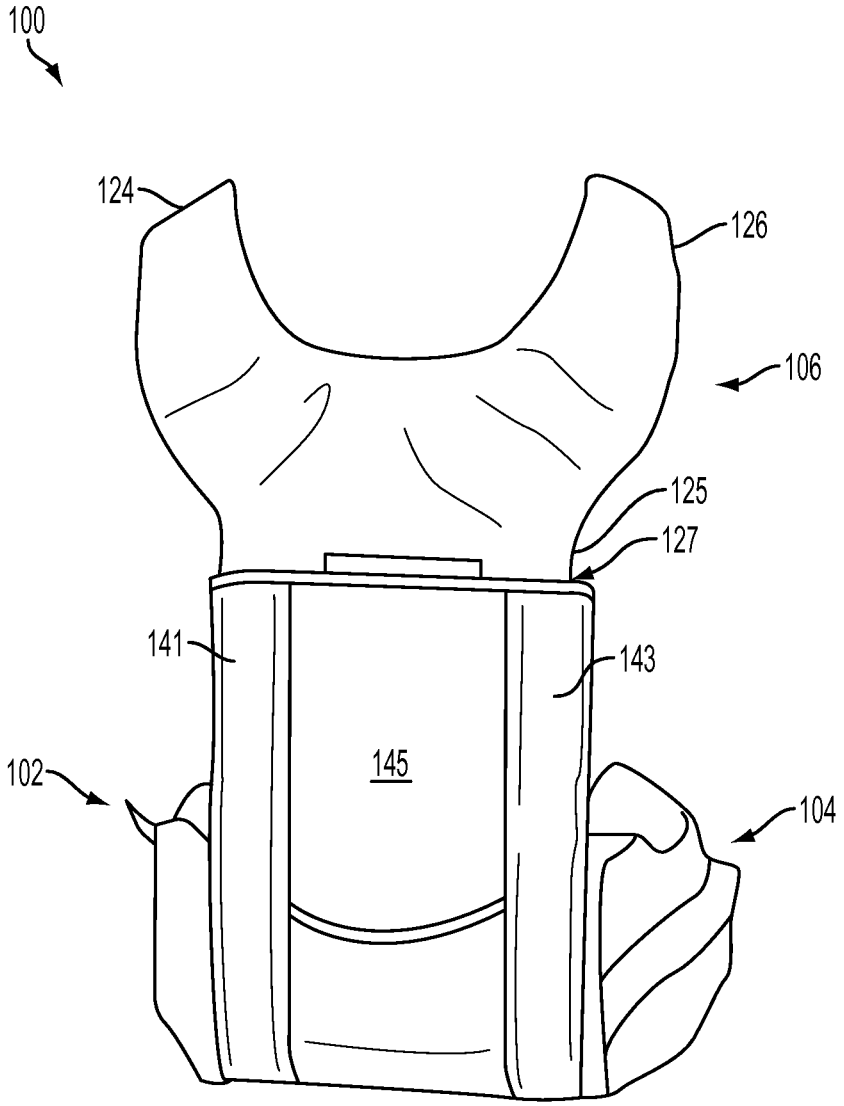
FIG. 3 is a rear view of a spine plate vest with the waistband closed according to an exemplary embodiment.
Figure 4:
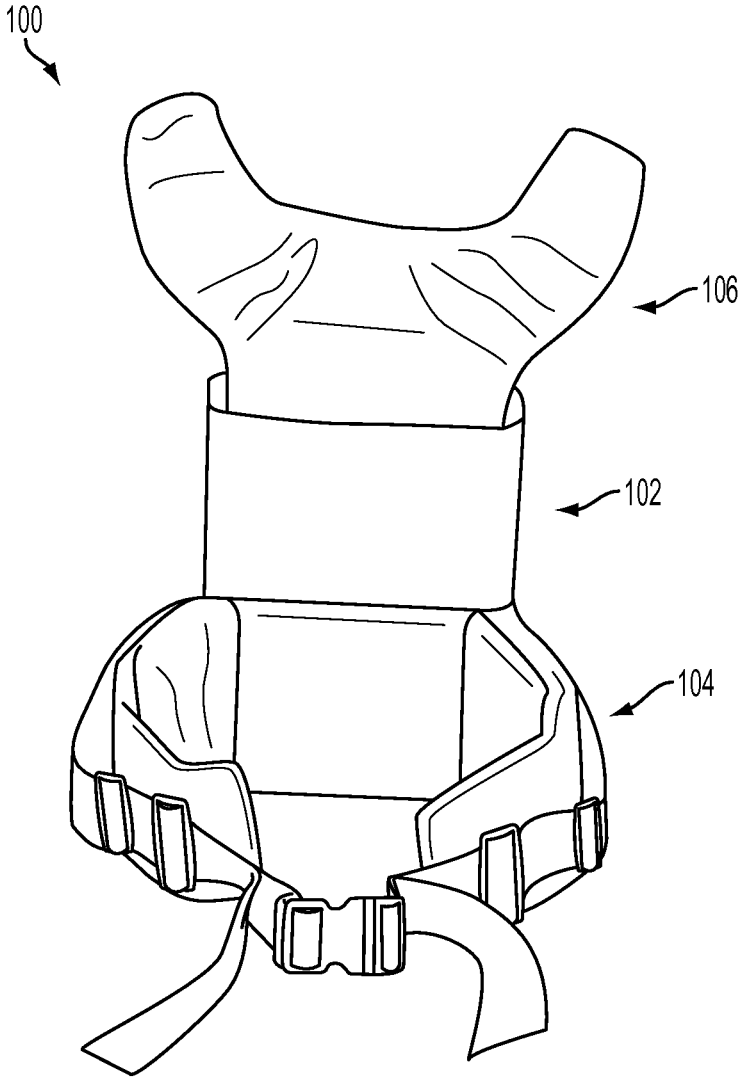
FIG. 4 is a front view of a spine plate vest with the waistband closed according to an exemplary embodiment.

FIG. 1 is a front view of an interior of a spine plate vest according to an exemplary embodiment. FIG. 2 is a back view of an exterior of a spine plate vest according to an exemplary embodiment. Referring to FIGS. 1-2, the spine plate vest 100 includes a back support 102 coupled to a waistband 104 and a shoulder interface 106 coupled to the back support 102. The back support 102 can include an inward-facing side opposite an outward-facing side, the inward-facing side connected to a center portion 135 of the waistband 104, a first pocket 108 e.g., a mesh pocket, positioned on the inward-facing side of the back support 102 and adapted for receiving a gel pack insert 108, a second pocket 145 (shown in FIG. 3) positioned on the outward-facing side of the back support 102 and adapted for receiving a spine ballistic plate 144, a first metal bar 140 (shown in FIG. 2) positioned between the inward-facing side and the outward-facing side of the back support 102, the first metal bar 140 adapted to receive a first side end 150 of the ballistic plate 144, a second metal bar 142 positioned between the inward-facing side and the outward-facing side of the back support 102, the second metal bar 142 adapted to receive a second side end 152 of the ballistic plate 144. Advantageously, the positioning of the first metal bar 140 and the second metal bar 142 in communication with the first side end 150 and the second side end 152 of ballistic plate 144 provides for deflecting and dissipating the impact of a bullet, shrapnel or other ballistic object away from the delicate spinal region towards non-critical outer areas of the back.

Figure 9:
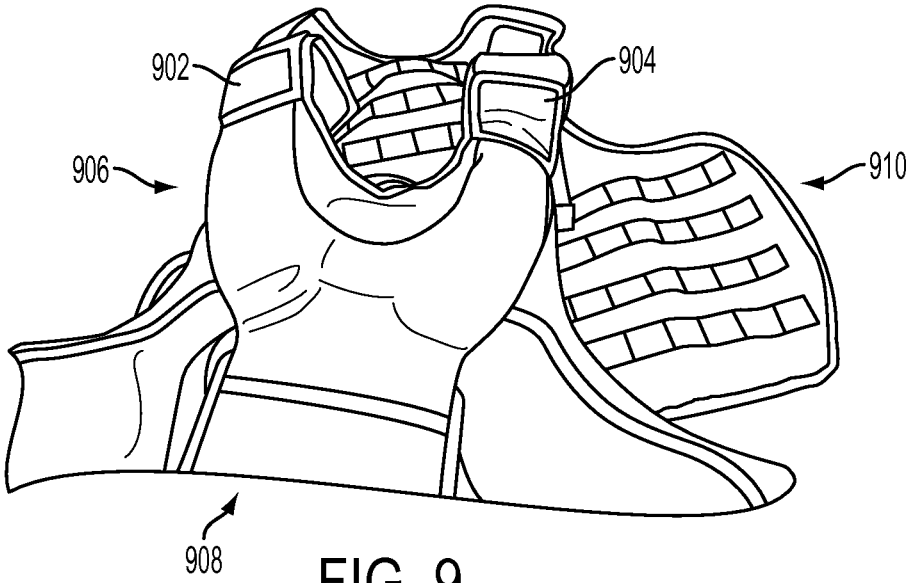
FIG. 9 is a front view of a spine plate vest system, which includes a spine plate vest coupled to a conventional ballistic bulletproof vest via a pair of sleeves according to an exemplary embodiment.

The waistband 104 can include an inward-facing side opposite an outward-facing side, the outward-facing side connected to the inward-facing side of the back support 102, a first plurality of pockets (e.g., mesh pockets) 112, 116 and 120 adapted for receiving a plurality of gel pack inserts 114, 118 and 122 on the inward-facing side, a plurality of ballistic plates 132, 134, 136 and 138 positioned between the inward-facing side and the outward-facing side of the waistband 104. The shoulder interface 106 can include a first flexible metal bar 146 positioned between an inward-facing side and an outward-facing side of the shoulder interface 106, a second flexible metal bar 148 positioned between the inward-facing side and the outward-facing side of the shoulder interface 106, where the shoulder interface 106 defines a first connection prong 124 and a second connection prong 126 protruding from a base portion 125 of the shoulder interface 106, the base portion 125 can be coupled to an upper end 127 of the back support 102. The first and second flexible metal bars 146 and 148 can extend from the bottom end of the back support 102 to the top end of the first and second connection prongs 124 and 126 of the shoulder interface 106. In other embodiments the first and second flexible metal bars 146 and 148 can extend from the bottom end of the shoulder interface 106 to the top end of the first and second connection prongs 124 and 126 of the shoulder interface 106. Accordingly the lengths of the first and second flexible metal bars 146 and 148 can vary to provide the amount of support desired. In one embodiment, a conventional ballistic bulletproof vest 910 (shown in FIG. 9) is placed in contact with the first connection prong 124 and the second connection prong 126 of the spine plate vest 100, that is, the ballistic bulletproof vest 910 will lay on and be supported by the first connection prong 124 and the second connection prong 126 of shoulder interface 106. In another embodiment, the ballistic bulletproof vest 910 can be secured to the spine plate vest 100 via a strap (e.g., a Velcro strap) 1006 (shown in FIG. 10) to stabilize the ballistic bulletproof vest 910 on the spine plate vest 100. In yet another embodiment, the ballistic bulletproof vest 910 can be attached to the spine plate vest 100 by a first sleeve 902 and a second sleeve 904 in which first connection prong 124 and the second connection prong 126 of shoulder interface 106 will engage first sleeve 902 and a second sleeve 904, respectively. In yet another embodiment, the spine plate vest 100 can be integrated into a conventional ballistic bulletproof vest 910 during manufacture.

In a similar manner to the ballistic bulletproof vest 910, the spine plate vest 100 can be used or deployed with a conventional backpack. For example, in one embodiment, a conventional backpack (not shown) is placed in contact with the first connection prong 124 and a second connection prong 126 of the spine plate vest 100, that is, the backpack will lay on and be supported by the first connection prong 124 and the second connection prong 126 of shoulder interface 106. In another embodiment, the backpack can be secured to the spine plate vest 100 via a strap (e.g., a Velcro strap) 1006 (shown in FIG. 10) to stabilize the backpack on the spine plate vest 100. In yet another embodiment, the backpack can be attached to the spine plate vest 100 by a first sleeve 902 and a second sleeve 904 in which first connection prong 124 and the second connection prong 126 of shoulder interface 106 will engage first sleeve 902 and a second sleeve 904, respectively. In yet another embodiment, the spine plate vest 100 can be integrated into a conventional backpack during manufacture. A modification kit (not shown) can be supplied for backpacks.

Figure 5:
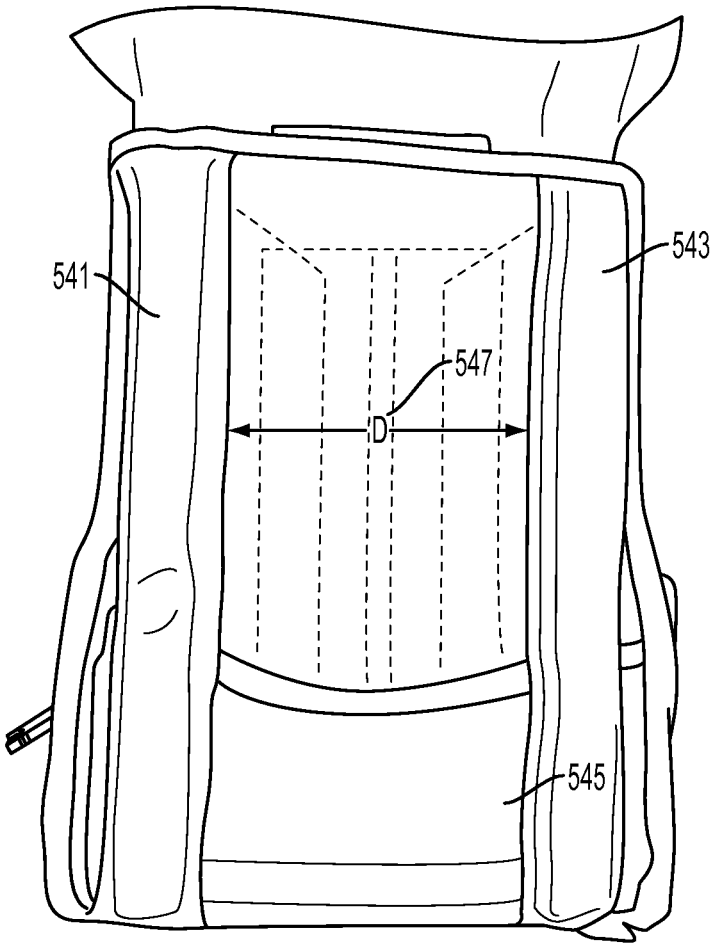
FIG. 5 is a rear view of a spine plate vest illustrating two sleeves containing two metal support bars according to an exemplary embodiment.
Figure 6:
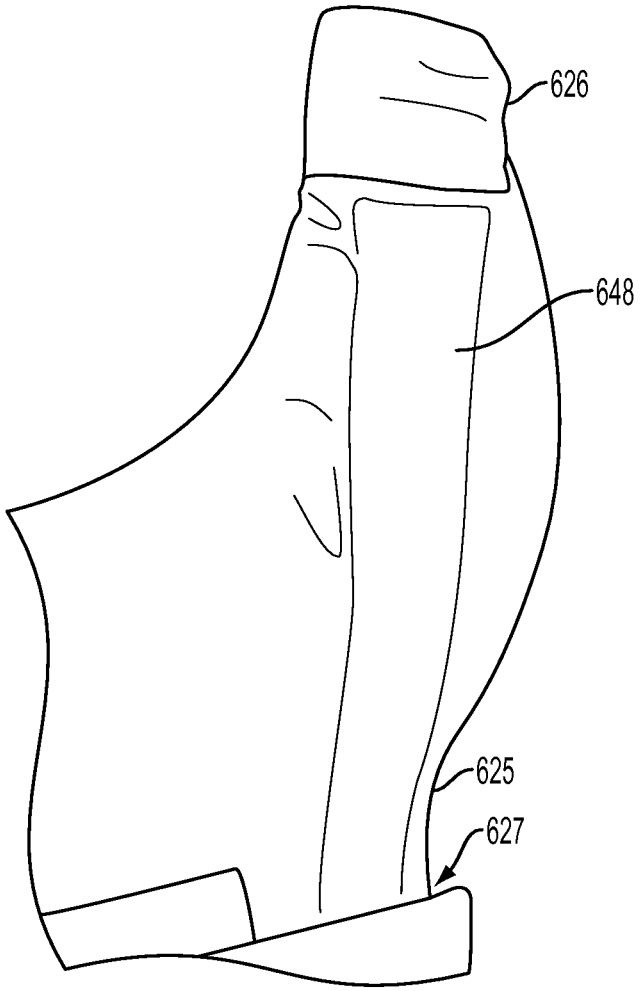
FIG. 6 is a cutaway view of a shoulder interface of a spine plate vest illustrating a sleeve containing a flexible metal bar according to an exemplary embodiment.

FIG. 5 is a rear view of a spine plate vest illustrating two sleeves 541 and 543 containing two metal support bars (not shown) according to an exemplary embodiment. As illustrated in FIG. 5, a distance D 547 is shown between the two metal support bars inside the two sleeves 541 and 543. Distance D 547 is determined by the width of the ballistic plate used with the spine plate vest 100.

Figure 7:
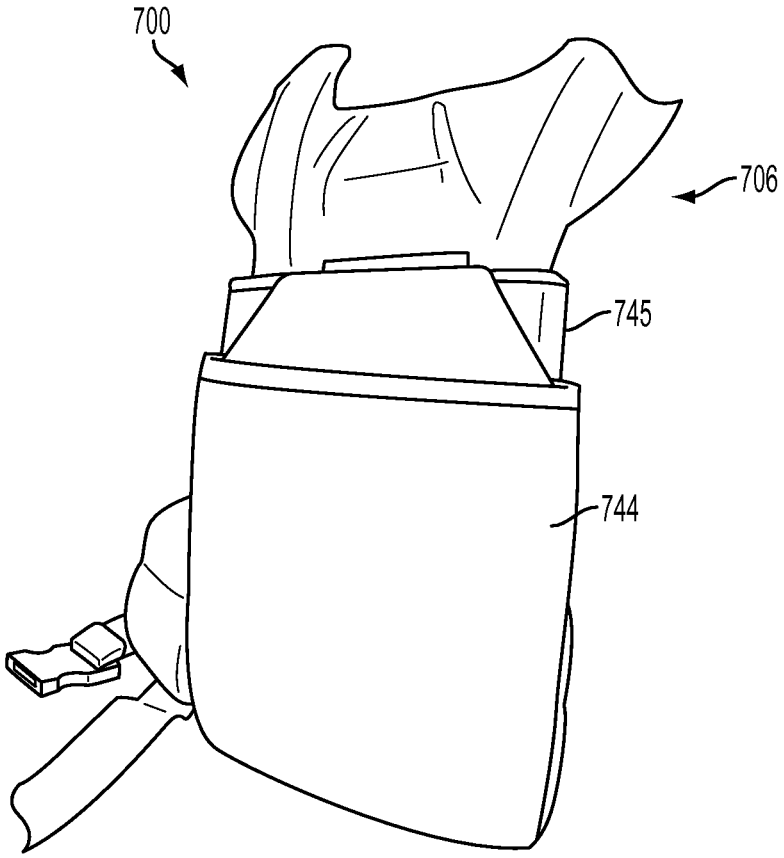
FIG. 7 is a rear perspective view of a spine plate vest illustrating a ballistic plate inserted into a spine ballistic plate pocket according to an exemplary embodiment.

FIG. 7 is a rear perspective view of a spine plate vest 700 illustrating a ballistic plate 745 inserted into a spine ballistic plate pocket 744 according to an exemplary embodiment.

Figure 8:
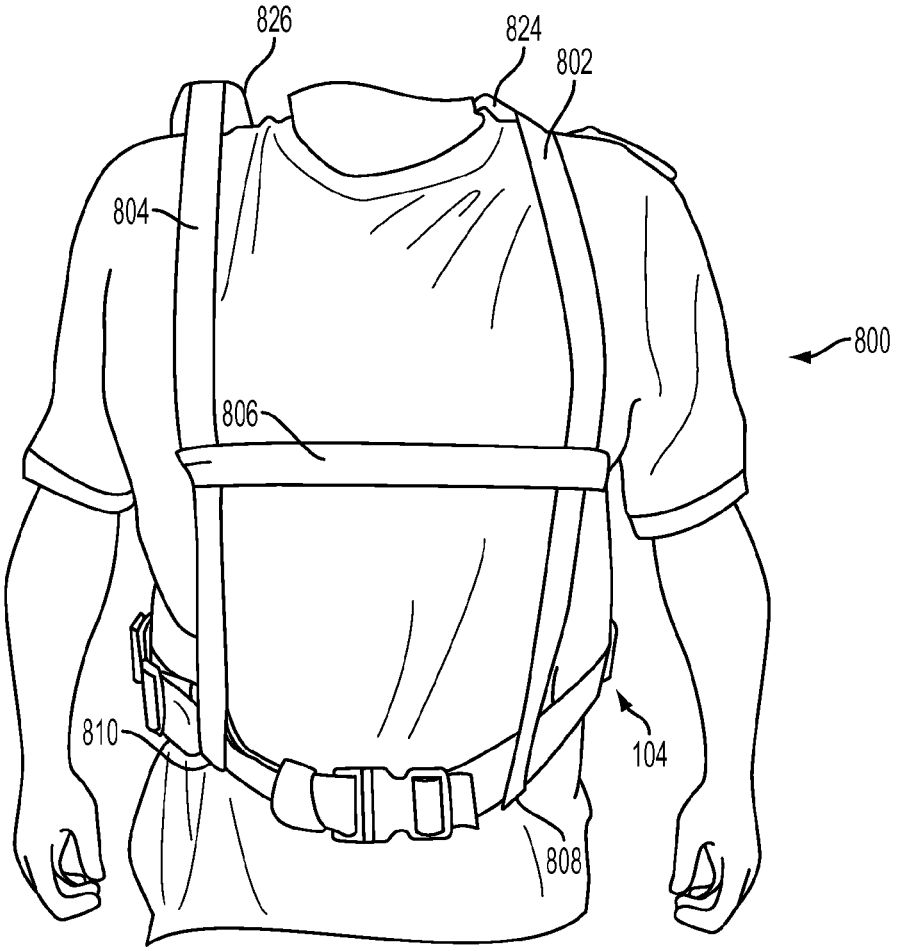
FIG. 8 is a front view of a harness assembly coupled to the spine plate vest to operate as a standalone spine plate vest according to an exemplary embodiment.

FIG. 8 is a front view of a harness assembly coupled to the spine plate vest to operate as a standalone spine plate vest according to an exemplary embodiment. The harness assembly 800 can include a pair of shoulder straps 802, 804 that attach to a first connection prong 824 and a second connection prong 826 of a spine plate vest 100. The first shoulder strap 802 will extend from the first connection prong 824 to the waistband 104. The second shoulder strap 804 will extend from the second connection prong 826 to the waistband 104. The ends of the first and second shoulder straps 802, 804 can be attached to the connection prongs 824, 826 and the waistband 104 by various connectors, such as quick connect buckles, D-rings or other fasteners. The harness assembly 800 further can include a reinforcement strap 806 between the first and second shoulder straps 802 and 804.

Figure 10:
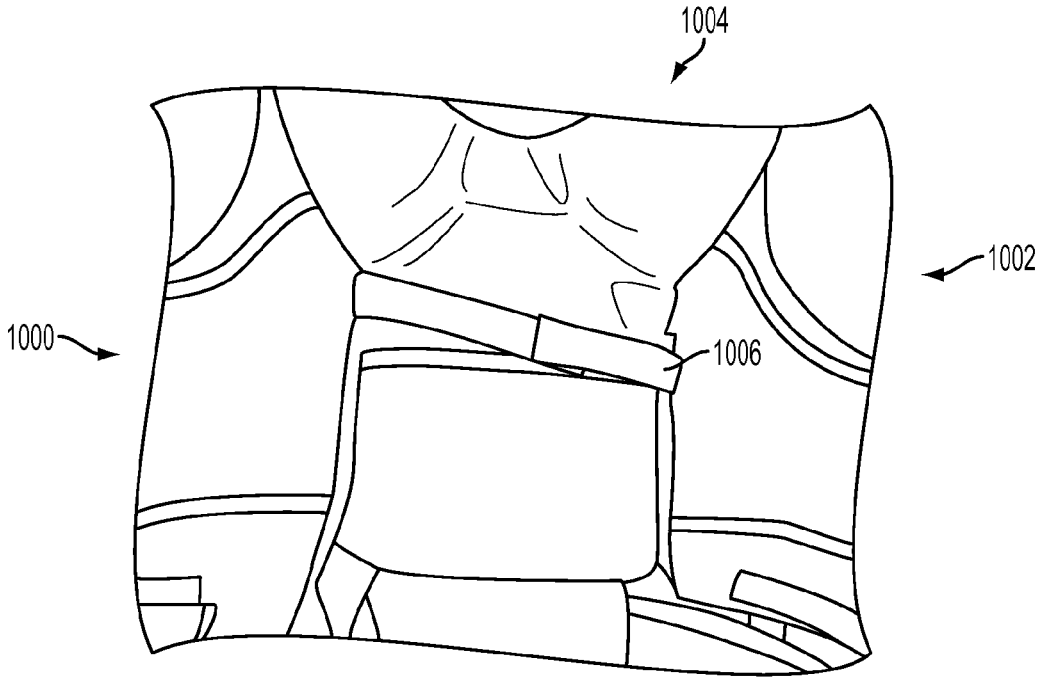
FIG. 10 is a front view of a spine plate vest system, which includes a spine plate vest coupled to a conventional ballistic bulletproof vest via a mid-strap according to an exemplary embodiment.

FIG. 10 is a front view of a spine plate vest system 1000, which includes a spine plate vest 1004 coupled to a conventional ballistic bulletproof vest 1002 via a mid-strap 1006 according to an exemplary embodiment.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A spine plate vest comprising:

a back support comprising:

an inward-facing side opposite an outward-facing side, the inward-facing side connected to a center portion of a waistband;

a first pocket positioned on the inward-facing side of the back support, the first pocket adapted for receiving a gel pack;

a second pocket positioned on the outward-facing side of the back support, the second pocket adapted for receiving a spine ballistic plate;

a first metal bar positioned between the inward-facing side and the outward-facing side of the back support, the first metal bar adapted to receive a first side end of the ballistic plate;

a second metal bar positioned between the inward-facing side and the outward-facing side of the back support, the second metal bar adapted to receive a second side end of the ballistic plate;

the waistband comprising:

an inward-facing side opposite an outward-facing side, the outward-facing side connected to the inward-facing side of the back support;

a first plurality of pockets adapted for receiving a plurality of gel packs on the inward-facing side;

a plurality of ballistic plates positioned between the inward-facing side and the outward-facing side of the waistband;

a shoulder interface comprising:

a first flexible metal bar positioned between an inward-facing side and an outward-facing side of the shoulder interface;

a second flexible metal bar positioned between the inward-facing side and the outward-facing side of the shoulder interface;

the shoulder interface defining a first connection prong and a second connection prong protruding from a base portion of the shoulder interface, the base portion coupled to an upper end of the back support.

2. The spine plate vest of claim 1, wherein the waistband includes a buckle.

3. The spine plate vest of claim 1 further comprising a harness assembly.

4. A spine plate vest system comprising:

a spine plate vest coupled to a tactical bulletproof vest, the spine plate vest comprising:

a back support comprising:

an inward-facing side opposite an outward-facing side, the inward-facing side connected to a center portion of a waistband;

a first pocket positioned on the inward-facing side of the back support, the first pocket adapted for receiving a gel pack;

a second pocket positioned on the outward-facing side of the back support, the second pocket adapted for receiving a spine ballistic plate;

a first metal bar positioned between the inward-facing side and the outward-facing side of the back support, the first metal bar adapted to receive a first side end of the ballistic plate;

a second metal bar positioned between the inward-facing side and the outward-facing side of the back support, the second metal bar adapted to receive a second side end of the ballistic plate;

the waistband comprising:

an inward-facing side opposite an outward-facing side, the outward-facing side connected to the inward-facing side of the back support;

a first plurality of pockets adapted for receiving a plurality of gel packs on the inward-facing side;

a plurality of ballistic plates positioned between the inward-facing side and the outward-facing side of the waistband;

a shoulder interface comprising:

a first flexible metal bar positioned between an inward-facing side and an outward-facing side of the shoulder interface;

a second flexible metal bar positioned between the inward-facing side and the outward-facing side of the shoulder interface;

the shoulder interface defining a first connection prong and a second connection prong protruding from a base portion of the shoulder interface, the base portion coupled to an upper end of the back support, wherein the first connection prong couples to a first sleeve of the ballistic bulletproof vest and the second connection prong couples to a second sleeve of the ballistic bulletproof vest.

* * * * *